United States Patent [19]

Takahashi

[11] 4,026,648

[45] May 31, 1977

[54] CLEANING DEVICE FOR USE IN ELECTROPHOTOGRAPHIC COPYING APPARATUS

[75] Inventor: Toru Takahashi, Tokyo, Japan

[73] Assignee: Canon Kabushiki Kaisha, Tokyo, Japan

[22] Filed: Jan. 20, 1975

[21] Appl. No.: 542,543

Related U.S. Application Data

[63] Continuation of Ser. No. 315,449, Dec. 15, 1972.

[30] Foreign Application Priority Data

| | | |
|---|---|---|
| Dec. 17, 1971 | Japan | 46-102921 |
| Dec. 20, 1971 | Japan | 46-103481 |
| Dec. 22, 1971 | Japan | 46-104339 |

[52] U.S. Cl. ..... 355/15; 15/256.5; 118/652

[51] Int. Cl.² ..... G03G 21/00

[58] Field of Search ..... 355/3 R, 3 TR, 15; 15/1.5, 256.5, 256.51, 256.52; 96/1.4; 118/637, 104

[56] References Cited

UNITED STATES PATENTS

| | | | |
|---|---|---|---|
| 3,195,500 | 7/1965 | Kuhnel | 118/104 X |
| 3,552,850 | 1/1971 | Royka et al. | 15/1.5 X |
| 3,633,543 | 1/1972 | Pitasi et al. | 118/637 X |
| 3,634,077 | 1/1972 | Sullivan | 96/1.4 |
| 3,660,863 | 5/1972 | Gerbasi | 355/15 |
| 3,711,796 | 1/1973 | Saito et al. | 355/15 |
| 3,713,736 | 1/1973 | Sargis | 355/3 R |
| 3,788,219 | 1/1974 | Gallagher | 118/104 X |
| 3,822,642 | 7/1974 | Grindeland | 118/104 X |

*Primary Examiner*—R. L. Moses

[57] ABSTRACT

In an electrophotographic copying apparatus of the image transfer type, an image transfer device comprises a rotatable transfer member for urging and transporting an image transfer medium to an electrophotographic photosensitive medium to transfer the image of the photosensitive medium to the transfer medium, a cleaning blade urged into contact with the surface of the rotatable transfer member to clean the same to remove any contaminant adhering thereto, and means for urging and holding the cleaning blade against the surface of the rotatable transfer member. The cleaning blade may also be arranged to clean the surface of the photosensitive medium in a similar manner.

12 Claims, 12 Drawing Figures a.b

| | a | b |
|---|---|---|
| |  |  |
| BLADE ANGLE $\theta$ | ACUTE ANGLE | OBTUSE ANGLE |
| SUPPORTING POSITION | BEFORE CLEANING POINT | AFTER CLEANING POINT |
| CLEANING EFFECT | LARGE | MEDIUM |
| LOAD | LARGE | SMALL |
| SOUND CHANGE | MEDIUM | SMALL |
| ROLLER FLAW | MEDIUM | SMALL | c.d.

| c | d |
|---|---|
|  |  |
| ACUTE ANGLE | OBTUSE ANGLE |
| AFTER CLEANING POINT | BEFORE CLEANING POINT |
| LARGE | SMALL |
| SMALL | MEDIUM |
| SMALL | MEDIUM |
| SMALL | SMALL |

| | |
|---|---|
| FIG. 2A | FIG. 2B |

FIG. 3(iii)
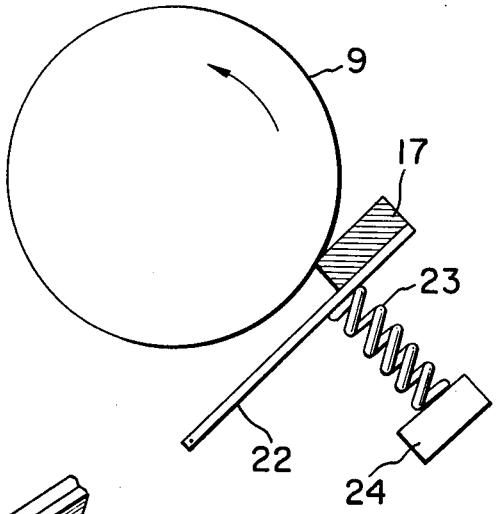

(HARDNESS: RUBBER HARDNESS 70 DEGREE)

CLEANING DEVICE FOR USE IN ELECTROPHOTOGRAPHIC COPYING APPARATUS

This is a continuation of application Ser. No. 315,449, filed Dec. 15, 1972.

BACKGROUND OF THE INVENTION

1. Field of the Invention

This invention generally relates to an electrophotographic copying apparatus, and more particularly to the cleaning of the surfaces of a photosensitive medium and image transfer device in such copying apparatus.

2. Description of the Prior Art

Electrophotographic copying apparatuses have recently been widely in use because of their capability of producing purely black-and-white copies at very high speeds and in a very simple manner. The electrophotography originated from the xerography invented by C. F. Carlson in 1938, and since then various versions of it have been developed and put into practice. These various electrophotographic processes may generally be grouped into two types, one of which is the system whereby an electrostatic latent image is formed on a photosensitive sheet of paper or the like, whereafter the formed image is developed with coloring toner and fixed directly on the sheet to provide a final copy. The other type is known as the image transfer system whereby an electrostatic latent image is formed on a photosensitive medium and then developed with coloring toner, whereafter such developed image is transferred to a separate transfer medium such as paper or the like and is fixed thereon to complete a final copy, the residual developer on the surface of the photosensitive medium is removed by cleaning the same for reuse. The former system has required the paper or the like to be coated with a photosensitive substance such as zinc oxide in order to impart the required photosensitivity. This has necessarily led to a higher cost and greater weight of the photosensitive sheet. The latter system is quite free of such disadvantages. In the transfer type electrophotographic copying apparatus, various types of image transfer means have heretofore been proposed and put into practice. In general, two types of transfer systems are known. First, there is the corona transfer system whereby an electrostatic latent image formed on a photosensitive medium is developed, an image transfer medium is afterwards superposed on the developed image, and then a corona discharge opposite in polarity to the charge in the toner is applied to the transfer medium from behind to thereby accomplish image transfer. Second there is and the roller transfer system whereby an electrically conductive roller with a voltage applied thereto is urged into contact with the back side of the transfer medium superposed on the developed image, to thereby achieve image transfer.

The first-named corona transfer system is meritorious in that (1) the photosensitive medium is free of any flaw or injury because the transfer means is not brought into physical contact with the photosensitive medium, and (2) the transfer medium is electrostatically urged against the photosensitive medium without any image transfer means being brought into contact with the back side of the transfer medium, thus avoiding any strain produced on the back side of the transfer medium due to the coloring toner. On the other hand, however, this system suffers from these demerits: (1) the transfer pressure of the transfer medium relative to the developed image on the photosensitive medium is so weak as to allow any slightest wrinkle or the like in the transfer medium to cause an air gap between the transfer medium and the developed image, thus resulting in an irregular image transfer effect, and this also imposes limitations on the type of the transfer medium and humidity because thin paper or high humidity would only result in poor image transfer effect: (2) the corona discharge itself is readily affected by temperature or humidity: and (3) the corona discharge electrode tends to be stained with toner and this causes an irregular discharge effect which in turn would result in an irregular transfer effect.

The second-named roller transfer system enjoys these advantages: (1) the transfer medium is sufficiently urged into contact with the photosensitive medium by the transfer roller so that the toner and the transfer medium intimately contact each other, thereby providing a good transfer image with the aid of the electric field applied to the transfer roller: (2) more or less wrinkles formed in the transfer medium under higher humidities could lead to no irregular image transfer because the transfer roller ensures a sufficiently intimate contact between the transfer medium and the developed image: and (3) ambient conditions such as temperature or humidity changes, and toner or like contaminant can in no way affect the transfer medium, thus avoiding any irregularity of the transfer effect. However, these advantages are accompanied by the following disadvantages: (1) if the transfer roller was stained with toner or like contaminant, it would stain the back side of the transfer sheet during the transfer process, thus providing an ugly final copy: and (2) if the transfer roller had a high degree of hardness, it would injure the photosensitive medium.

SUMMARY OF THE INVENTION

It is a primary object of the present invention to provide an improved image transfer device for electrophotographic copying apparatus which ensures an ideal image transfer to be accomplished during a roller transfer process.

It is another object of the present invention to provide an improved image transfer device which prevents any contaminant from being transferred from the transfer roller to the back side of a transfer medium during the image transfer process.

It is still another object of the present invention to provide an improved image transfer device which can clean up the surface of the transfer roller to remove any contaminant adhering thereto.

It is yet another object of the present invention to provide an improved image transfer device which employs a doctor blade to perfectly clean up the surface of the transfer roller.

It is a further object of the present invention to provide an improved image transfer device which can clean up the transfer roller without producing any sound change.

It is still a further object of the present invention to provide an improved image transfer device which can avoid any increase in the load imparted to the transfer roller during the cleaning process.

It is yet a further object of the present invention to provide an improved image transfer device which prevents any flaw from being imparted to the surface of the transfer roller during the cleaning process.

It is still a further object of the present invention to provide an improved image transfer device which prevents any flaw from being imparted to the photosensitive medium by the transfer roller.

It is a further object of the present invention to provide an improved image transfer device which employs a doctor blade to perfectly clear away any residual developer on the surface of the photosensitive medium.

It is a further object of the present invention to provide an improved electrophotographic copying apparatus which prevents any sound change from being produced during the blade-cleaning of the surface of the photosensitive medium, and which reduces the load imparted to the surface of the photosensitive medium by the blade and further prevents the blade from injuring said surface.

In the electrophotographic copying apparatus of the present invention, residual developer exists on the surface of the photosensitive medium after the image transfer and such residual developer must be cleared away to reuse of the photosensitive medium.

On the other hand, in such copying apparatus, particles of toner or the like are always in suspension within the interior space of the apparatus and such particles tend to fly over to the image transfer station to adhere to the surface of the transfer roller thereof. Since the transfer roller is always urged into contact with the surface of the photosensitive medium, the toner present on the surface of the photosensitive medium would shift and adhere to the transfer roller after a transfer medium passes through the image transfer station. Such contaminant adhering to the transfer roller surface would in turn shift to the back side of the transfer medium during the image transfer process, thus remaining thereon to provide a stained final copy. Therefore, according to the present invention, such residual developer or contaminant may be removed by a doctor blade urged into contact with the surface of the photosensitive medium or of the transfer roller, thereby making the photosensitive medium perfectly ready for reuse. Thus, the present invention can provide a very desirable roller transfer device which fully utilizes the advantages of the roller transfer system while eliminating the disadvantages inherent thereto.

BRIEF DESCRIPTION OF THE DRAWINGS

A better understanding of the present invention may be had from the following detailed description of some specific embodiments thereof taken in conjunction with the accompanying drawings, in which:

FIG. 3(iii) shows another form of the FIG. 3(i) embodiment;

DESCRIPTION OF THE PREFERRED EMBODIMENTS

Figure 1:
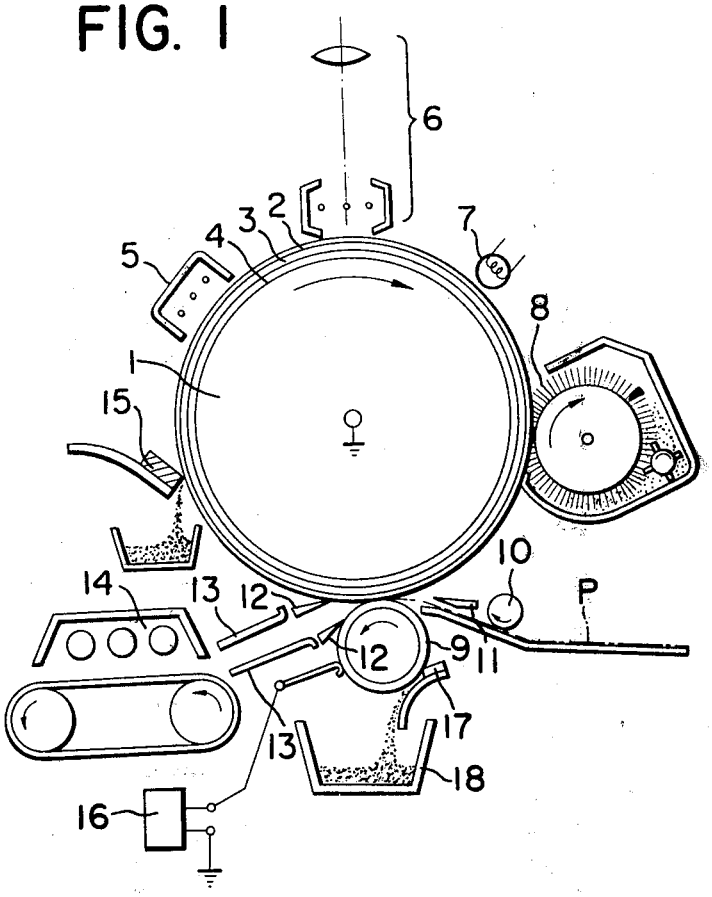
FIG. 1 is a schematic representation of an embodiment of the electrophotographic copying apparatus according to the present invention.

Referring to FIG. 1, there is shown an electrophotographic copying apparatus to which has been applied the electrophotographic process developed by Applicant (see U.S. Pat. No. 3,438,706). The apparatus includes a photosensitive drum 1 which has on its peripheral surface a photosensitive layer comprising a dielectric layer 2, a photoconductive layer 3 and a conductive back-up layer 4 and which is rotatable in the direction indicated by the arrow. The apparatus further includes a primary charger device 5 provided to charge the surface of the photosensitive drum with a suitable polarity of charge, and a secondary charger and exposure device 6 for simultaneously applying image light and a charge of the opposite polarity or AC corona discharge to the photosensitive layer on the drum, whereby an electrostatic latent image may be formed on the surface of the photosensitive medium. If required, an overall exposure device 7 may further be provided to subject the surface of the photosensitive medium to overall exposure to thereby increase the contrast of the formed electrostatic latent image. Thus, the photosensitive drum with an electrostatic latent image formed thereon may subsequently be developed by a developing device 8. In FIG. 1, the developing device is shown as a dry type developing device employing a magnetic brush or a fur brush, whereas a wet type developing device may also be employed such as the type in which the photosensitive drum is dipped in a body of developing liquid or the type in which the photosensitive drum is subjected to ejection of developing liquid. After being developed, the formed image may reach an image transfer station, which comprises a transfer roller 9 formed of conductive material and having a bias voltage applied thereto from a voltage source 16. Usually, the polarity of the voltage is opposite to that of the toner so as to enhance the efficiency of transfer of the developed image. On the other hand, a transfer medium P may be conveyed by a transfer medium transport roller 10 and guide plate 11 in synchronism with the movement of the developed image and urged into contact with the surface of the photosensitive drum by the transfer roller 9. The transfer medium P may be formed of paper, plastics, printing master or the like. After the image transfer, the transfer medium may be separated from the photosensitive drum by a separator means and delivered along a guide plate 13 to a heating-fixing station 14 using an infrared ray lamp or like means, where the transfer medium may be heated for fixing the image thereon to provide a final copy, which may then be discharged out of the copying apparatus. After the image transfer has been done at the image transfer station, the photosensitive drum may have residual developer thereon, and therefore, such residual developer may be scraped off by a cleaning device 15 so as to make the photosensitive drum ready for reuse. In the illustrated embodiment, the cleaning device is shown as using a doctor blade of rubber or like material to scrape off the developer. Particularly, in the case where the outermost layer of the photosensitive medium is a dielectric layer as shown in FIG. 1, such layer permits intense cleaning to be effected by the doctor blade and thus ensures a very high cleaning effect.

In the described manner, the electrophotographic copying apparatus shown in FIG. 1 may complete a cycle of copying operation.

Description will now be made particularly of the manner in which the surfaces of the photosensitive medium and image transfer roller in the electrophotographic copying apparatus are cleaned up. Herein, the cleaning will be exemplarily described with respect to the image transfer roller, but it should be understood that the ensuing description equally holds true with the cleaning of the photosensitive medium. In FIG. 1, the transfer roller 9 is normally urged into contact with the surface of the photosensitive drum 1. Thus, the transfer roller is being rotated in direct contact with the surface of the photosensitive drum when no transfer medium is present in the image transfer drum surface tends to shift and adhere to the surface of the transfer roller. Such adhering toner would in turn shift to the back side of the transfer medium, which would thus provide a final copy having its back side stained. Also, even if the transfer roller is so designed that it is out of contact with the photosensitive drum surface except during the image transfer process, the toner particles suspended within the copying apparatus would stick to the transfer roller to thereby stain the same. Such suspended toner particles have heretofore resulted in an appreciably stained back side of the copy.

According to the present invention, cleaning means is provided to remove such contaminant as the toner particles sticking to the transfer roller surface to thereby prevent the back side of a copy from being stained. The cleaning means may be such as a web cleaner having a roll of paper adapted for frictional contact, a pad cleaner having sponge, felt or like material for frictional contact, or a brush cleaner using a fur brush for scraping off the toner particles, and any of these various means could be successful to some extent. With these means, however, it has been difficult to completely remove the contaminant which usually adheres to the transfer roller surface very firmly. For this reason, the present invention employs a cleaning blade formed of rubber, plastics, or like material. The use of such blade cleaner achieves a very high cleaning effect as well as greatly simplifies the cleaning device. In the case of FIG. 1, a member 17 disposed for frictional contact with the peripheral surface of the transfer roller 9 provides the blade cleaner, below which is provided a receptacle 18 for the toner or like comtaminant removed by the blade cleaner.

A specific construction of the blade cleaner will now be described in detail with reference to FIG. 2. As shown there, the blade cleaner may generally be grouped into four types. Respective terms appearing in FIG. 2 will first be explained. "Supporting position": see FIG. 2*e*, in which O is the center of the transfer roller and C is the cleaning point on the roller surface: the letter A designates the tangential direction at point C with respect to the direction of rotation of the transfer roller: the normal OB passing from point O through point C is utilized as the reference line and the "supporting point" of the doctor blade is represented by P; the supporting point is said to be in "before" position when it lies on that side toward the direction A beyond the line OB, and said to be in "after" position when it lies on the opposite side. "Load" means the rotational load of the transfer roller imparted by the frictional contact of the blade cleaner therewith. "Sound change" means the degree of the abnormal sound produced by the friction between the blade cleaner and the transfer roller during the rotation of the latter. The various data shown in FIG. 2 are only an example of empirical data, and some exceptions may be possible therein.

Figure 2E:
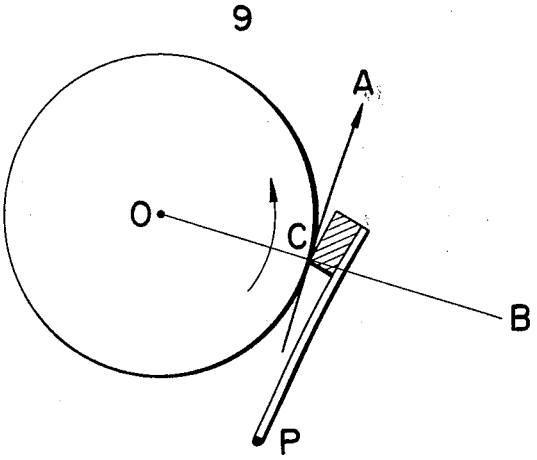
FIGS. 2*a*, *b*, *c*, *d*, and *e* particularly illustrate various forms of the image transfer device in the electrophotographic copying apparatus of the present invention.
Figure 2A:
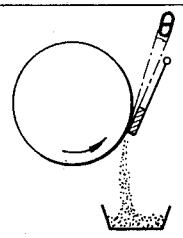
Figure 2A:
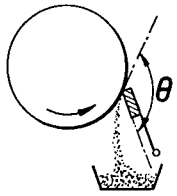
Figure 2B:
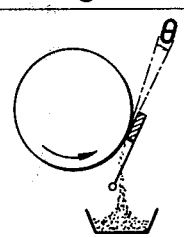
Figure 2B:
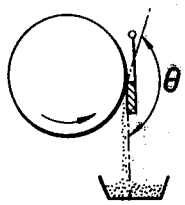

Studies on the various empirical data shown in FIGS. 2*a*, *b*, *c* and *d* have shown the following facts. Although any of the embodiments *a*, *b*, *c* and *d* is practicable, embodiments *a* and *c* are especially high in cleaning effect. This may be considered to be related to the fact that the angle of contact $\theta$ between the blade of the blade cleaner and the surface of the rotating roller is an acute angle. Among others, the embodiment *c* is highly practical in that the load and the possibility of sound change are small. This would be related to the fact that the supporting point of the blade cleaner is located after the cleaning point.

Figure 3I:
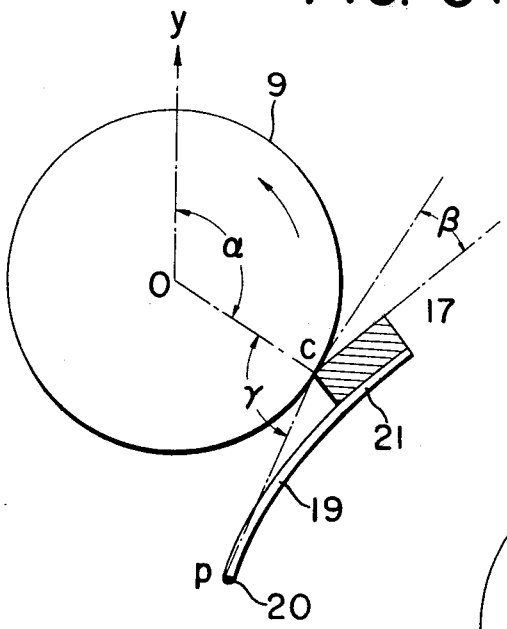
FIG. 3(i) more particularly illustrates the form shown in FIG. 2*c;*
Figure 3:
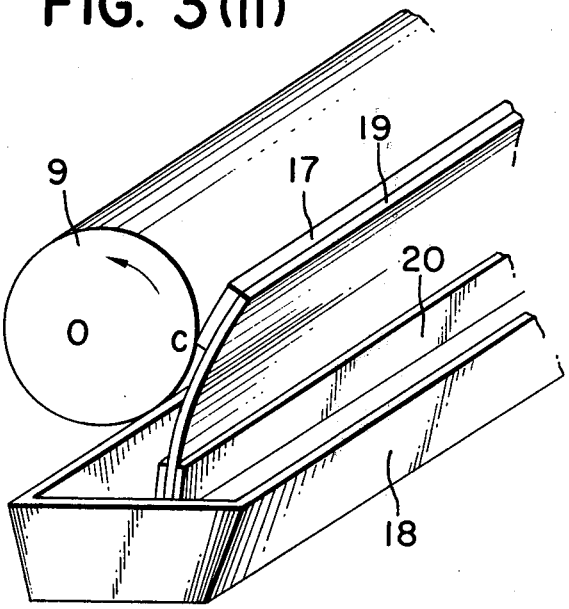
FIG. 3(ii) is a perspective view of the FIG. 3(i) form as assembled into a unit.

The embodiment *c* will be described more particularly. FIGS. 3(i) and (ii) specifically illustrate the blade cleaner according to the embodiment *c*. The transfer roller is designated by 9, and the blade is designated by 17 and attached to a support spring 19 secured to a fixed support portion 20. The support spring 19 is formed of a resilient material such as plate of phosphor bronze, rubber or the like, and serves to urge the blade against the surface of the transfer roller. In FIG. 3, *y* represents the vertical direction from the center O of the transfer roller, $\alpha$ represents the angle between Oy and OC. $\beta$ represents the angle between the tangent line at point C on the transfer roller, and $\gamma$ represents the angle between the line OC and the line CP. The angle $\alpha$ represents the location of the cleaning point of the blade and this is selected so as to permit the toner or like contaminant to readily drop when removed by the cleaning action. Too small a value for the angle $\beta$ would reduce the cleaning effect, and too great a value would increase the sound change. The angle $\gamma$ represents a suitable range for the position of the fixed support point at which the blade is mounted and supported, and this angle is selected with respect to such factors as the load imparted to the rotating transfer roller by the blade bearing thereagainst, the cleaning effect, etc. The available range, the suitable range and the optimum range for the respective angles $\alpha$, $\beta$ and $\gamma$ are shown in the table below.

| | Available range | Suitable range | Optimum range |
|---|---|---|---|
| $\alpha$ | 0 – 360° | 90 – 180° | 120 – 150° |
| $\beta$ | 0 – 90° | 5 – 45° | 5 – 30° |
| $\gamma$ | 0 – 180° | 90 – 150° | 90 – 120° |

While the construction of the blade cleaner has been described in detail, it should be noted that the materials for the transfer roller and blade must be fully taken into account to increase the cleaning effect on the surface of the transfer roller. First, the material for the blade will be discussed. The blade may preferably comprise a plate of rubber, plastics or like material having a thickness of the order of 0.5 to 10 mm, and further may have the edge 21 (see FIG. 3) formed of any of the materials enumerated below. The material forming the edge must be chosen in terms of such factors as wear resistance, heat resistance, hardness, frictional charging, etc. Available materials include synthetic rubber such as polyurethane, neoprene, nitrile, ethylene propylene copolymer, etc., or plastics such as tetrafluoroethylene, polyethylene, polycarbonate, or metals. Above all, polyurethane has been found to be best in all respects. The hardness may preferably be above 30° and most suitable in the range of 60° to 95°. When rubber or plastics is employed, it is essential that the plasticizer must not be solvent of toner.

Next, with regard to the support spring, it may be formed of plate rubber, plastics or metal plate, namely, a material which is resilient in itself and capable of urging the blade against the roller. To that end, steel, phosphor bronze, polyurethane, nitrile rubber or the like is most preferably. Alternatively, as shown in FIG. 3(iii), it is of course possible to employ a non-resilient material for a support member 22 supporting the blade and employ a separate spring or like means 23 to urge the blade against the roller, although this is more complicated. In FIG. 3(iii), numeral 24 designates a fixed support member.

Figure 4:
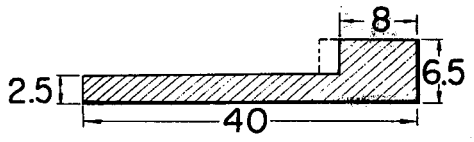
FIG. 4 shows an example of the blade cleaner.

The spring pressure imparted by the support spring or by the separate spring means may preferably be of the order of 0.5 to 3.5 kg/30cm. In FIG. 4, there is shown an embodiment in which the blade and support spring are formed integrally with each other by the use of polyurethane rubber. In the figure, the various numerical values indicate the respective dimensions in millimeters. In order to increase the cleaning effect, the edge may be sharpened by cutting away the portion indicated by dotted lines with the aid of a sharp cutting tool, after the formation of the unitary member.

Figure 5:
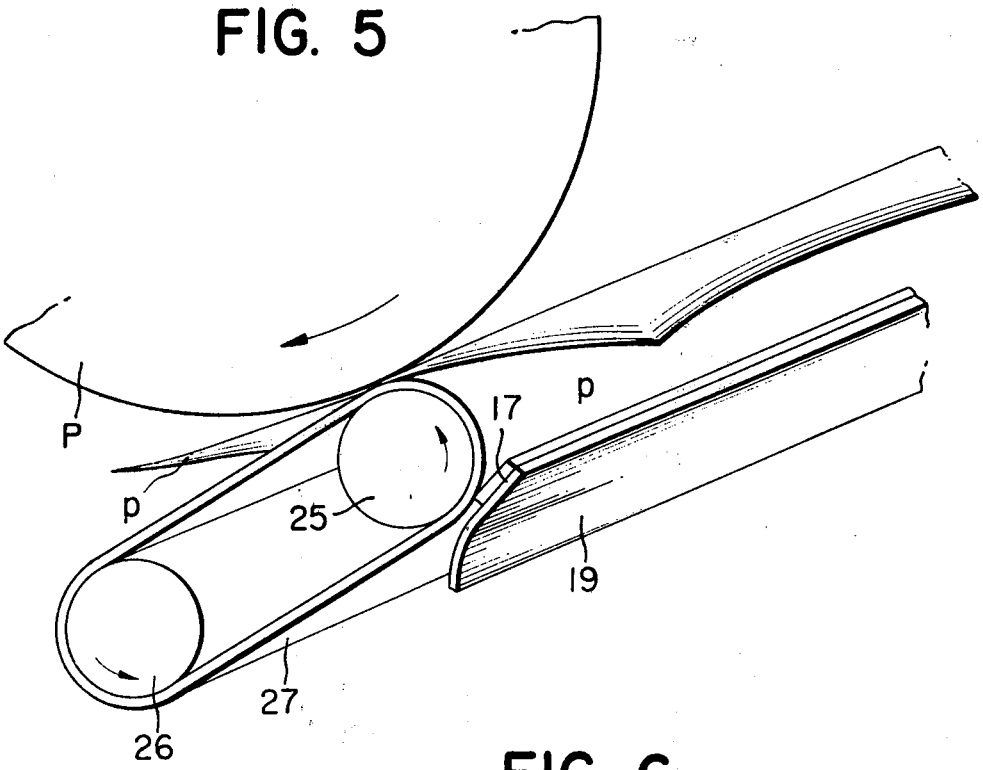
FIG. 5 is a perspective view showing an embodiment of the present invention which employs a blade cleaner comprising a combination of two rollers and a belt wrapped thereabout.

While the use of a transfer roller as the image transfer means has been described above, the cleaning blade 17 so set as shown in FIG. 5 may also be effectively used with an image transfer means comprising a first roller 25, a second roller 26 and a belt 27 extending over the two rollers. Letter P designates a transfer medium, and numeral 1 designates a photosensitive drum.

In order to increase the cleaning effect on the surface of the transfer roller, another important factor is the material forming the surface of the transfer roller or the belt. At least the surface of the transfer roller must be conductive ($10^6\Omega$cm or less) and also must permit good peel-off of toner therefrom. Such surface may be provided by a conductive coating of good toner peel-off characteristic laid over an insulative rubber material. Various surface forming materials may be used, but those shown below are most excellent.

1. Paint of conductive polyethylene terephthalate applied by baking;
2. heat-constrictive and conductive polyethylene tube;
3. heat-constrictive and conductive ethylenepropylene copolymer tube; and
4. conductive silicon tube.

Also, one of these materials blended with fine particles of molybdenum sulfide is excellent. Among these materials, the conductive silicon tube is especially superior in the toner peel-off characteristic. To control the toner peel-off characteristic, the tube once formed may be immersed for 5 minutes to 100 hours in a solvent (suitably, toluene) containing a predetermined amount of low-molecular substance of silicon resin or containing no such substance, thereby increasing or decreasing the low-molecular parts (monomers and oligomers).

Figure 6:
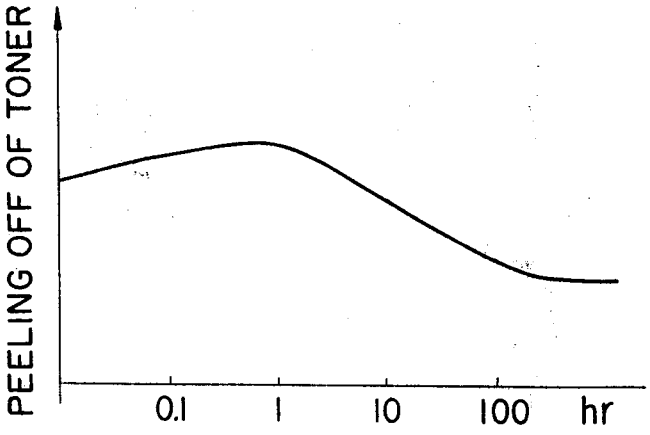
FIG. 6 is a graph illustrating the variations in the tone peel-off characteristic for the time during which a conductive silicon tube is immersed in pure toluene.

FIG. 6 graphically shows an example of the variations in toner peel-off characteristic when the tube is immersed in pure toluene. In the graph, the abscissa represents the time during which the tube is immersed, while the ordinate represents the toner peel-off characteristic corresponding to the immersing time. It can be seen that the toner peel-off characteristic reaches its maximum when the immersing time is about 1 hour. Thus, the peel-off characteristic of the roller surface may be controlled to thereby control the cleaning characteristic thereof while the tube may increase its diameter due to the swelling of the solvent, whereupon the tube may be fitted over a base roller and then dried for constriction. This is very advantageous in the manufacture of the roller.

The roller transfer system suffers from another disadvantage in that flaws or injuries may be imparted to the photosensitive medium by the transfer roller urged into contact therewith. A solution to this would be to soften the transfer roller. Usually, a conductive rubber roller unavoidably tends to harden itself because the amount of the plasticizer used in the rubber roller is economized so as not to affect the toner and because carbon or like material is added to provide a conductivity for the rubber roller. Thus, the hardness of the rubber roller is in the range of 70° to 40°. To avoid any flaw or injury in the surface of the photosensitive medium, the hardness must be reduced below the shown range. For this purpose, the transfer roller may be formed of two layers, of which the base layer may be formed as a conventional soft rubber roller (up to 10° hardness), or a sponge roller or a hollow member, whose peripheral surface may be covered with a conductive coating layer to thereby provide a good degree of hardness. As the material for such coating layer, the aforesaid materials are suitable in terms of cleaning effect. Also, silicon rubber, which can form a soft tube without using any plasticizer, is suitable for the formation of a single-layer transfer roller in that good softness is provided and that toner fusion is avoided.

As has been discussed above from various points of view, the electrophotographic copying apparatus of the present invention employs a highly effective blade type cleaner device for cleaning the surfaces of the photosensitive medium and transfer roller, whereby the surface of the photosensitive medium may be perfectly cleaned and accordingly the transfer medium may be free of any stain which would otherwise occur on the back side thereof, thus ensuring aesthetically satisfactory copies to be provided. By suitably selecting such factors as the angle of the blade with respect to the surface of the photosensitive medium or of the transfer roller, the mounting position of the blade and the like, it is possible to provide an apparatus of very excellent mechanical characteristics which produces minimum noise during cleaning operation and which imparts no flaw or injury to the surface of the photosensitive medium and/or of the transfer roller. Furthermore, the thorough-going investigations carried out as to the material for the transfer roller surface have succeeded in providing a transfer roller both of excellent image transfer efficiency and excellent toner peel-off characteristic, which roller permits the cleaning effect to be achieved to an ideal extent.

Usually, the transfer roller is driven in synchronism with the photosensitive medium by the drive transmission from the latter which results from the direct contact therebetween. Therefore, a great magnitude of load, if imparted from the cleaning member to the transfer roller, would cause the latter to slip and produce a misaligned image transfer, whereas the present invention solves this problem by minimizing such load.

Although the cleaning device as shown and described above excellently performs as a cleaner for the surfaces of the photosensitive medium and transfer roller, it is apparent that such cleaning device can also be used to clean other cylindrical surfaces such as a transport roller which requires powdered toner to be removed therefrom.

While the present invention has been shown and described with respect to some specific embodiments thereof, it is to be understood that the present invention is not restricted to those embodiments but it covers various changes and modifications which may be made without departing the spirit and scope of the invention as defined in the appended claims.

I claim:

1. Apparatus comprising a movable supporting member having contaminating matter disposed on a surface thereof, and a cleaning device for removing said contamination matter froms said surface, said cleaning device comprising:

an elongated blade of resilient material, said blade having two surfaces meeting to form an extended wiping edge; and resilient mounting means disposed adjacent said supporting member for maintaining the wiping edge of said blade in pressure contact with said supporting member surface, said resilient mounting means having said blade connected at one end thereof so that one of said two surfaces of said blade generally faces the other end of said mounting means, and so that the other of said two surfaces of said blade generally faces said supporting member and extends from its said contact position in the downstream direction with respect to the direction of movement of said supporting member, said mounting means having its said other end secured at a position located upstream from said contact position of said wiping edge.

2. Apparatus according to claim 1, wherein said supporting member is a rotating member for image transfer provided to transport a transferring material in press-contact with a photosensitive member for transferring a developed image on said photosensitive member to said transferring material.

3. Apparatus according to claim 2, wherein said rotating member for image transfer is a rotating roller.

4. Apparatus according to claim 2, wherein said rotating member for image transfer is an endless belt.

5. Apparatus according to claim 2, wherein said rotating member for image transfer comprises a sponge layer and a conductive silicone layer overlaid on said sponge layer.

6. Apparatus according to claim 5, wherein said conductive silicone layer contains solvent to provide controlled separability of said contaminating matter.

7. Apparatus according to claim 5, further comprising means for applying a voltage to said conductive silicone layer, wherein said voltage has a polarity opposite to that of said developed image.

8. Apparatus according to claim 1, wherein said mounting means for said cleaning blade is an elastic plate.

9. A cleaning device according to claim 8, wherein said cleaning blade and said elastic plate comprise a unitary structure.

10. Apparatus according to claim 1, wherein said mounting means for said cleaning blade includes a spring mounted to urge said cleaning blade toward said supporting member surface.

11. Apparatus according to claim 1, wherein said supporting member is an electrophotographic photosensitive member.

12. A cleaning device according to claim 11, wherein said electrophotographic photosensitive member comprises a surface insulating layer and a photoconductive layer.

* * * * *

UNITED STATES PATENT AND TRADEMARK OFFICE

CERTIFICATE OF CORRECTION

PATENT NO. : 4,026,648
DATED : May 31, 1977
INVENTOR(S) : TORU TAKAHASHI

It is certified that error appears in the above–identified patent and that said Letters Patent are hereby corrected as shown below:

Column 1, line 65, change "strain" to read --stain--.

Column 9, line 23, change "froms" to read --from--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*